US005667091A

United States Patent [19]

Slaber, Jr. et al.

[11] Patent Number: 5,667,091

[45] Date of Patent: Sep. 16, 1997

[54] MOUNTING SYSTEM FOR FLOATING ROOF SEALS

[75] Inventors: Arthur W. Slaber, Jr., Naperville; Terry A. Gallagher, Wheaton, both of Ill.

[73] Assignee: Chicago Bridge & Iron Technical Services Company, Oak Brook, Ill.

[21] Appl. No.: 365,777

[22] Filed: Dec. 29, 1994

[51] Int. Cl.[6] ..... B65D 88/46

[52] U.S. Cl. ..... 220/224; 220/222; 411/352; 411/353

[58] Field of Search ..... 220/216, 218, 220/222, 224, 578; 411/352, 353

[56] References Cited

U.S. PATENT DOCUMENTS

| | | |
|---|---|---|
| 1,514,116 | 11/1924 | Wiggins . |
| 1,666,415 | 4/1928 | Gallagher . |
| 1,666,416 | 4/1928 | Griffin . |
| 1,892,144 | 12/1932 | Griffin . |
| 1,979,657 | 11/1934 | Wiggins . |

(List continued on next page.)

FOREIGN PATENT DOCUMENTS

| | | | |
|---|---|---|---|
| 103146 | 2/1960 | Norway | 220/222 |

OTHER PUBLICATIONS

Chicago Bridge & Iron Co., "Procedure for Field Installation of SR-1A Metallic Shoe Primary Seal VS-100 Secondary Seal (Vertical & Horizontal Mounted)," Construction Manual No. 35, pp. 1-23, Feb. 18, 1994 with four page Interoffice Correspondence, Sep. 13, 1994.

Fred Moyer, Chicago Bridge & Iron Co., "Floating Roofs," pp. 1-25 (one page chart), Jan. 15, 1957.

TRW Brochure on Pushnut® Bolt Retainers (one page)(undated).

Voltek Brochure on Volara® Crosslinked Polyethylene Foam (seven pages) (undated).

*Primary Examiner*—Stephen K. Cronin

*Attorney, Agent, or Firm*—Marshall, O'Toole, Gerstein, Murray & Borun

[57] ABSTRACT

A sealing system for a cylindrical liquid floating roof storage tank includes a primary seal and a secondary seal mounted on a rim extending upwardly from a floating roof. The system for mounting the seals to the floating roof includes a bolt, a retainer for securing the primary seal to the rim, and a nut for securing the secondary seal to the rim, wherein installation or removal or the secondary seal does not compromise the primary seal connection.

46 Claims, 4 Drawing Sheets

U.S. PATENT DOCUMENTS 2,426,755 9/1947 Ulm .
2,471,404 5/1949 Boberg .
2,478,422 8/1949 Plummer .
2,536,019 1/1951 Allen .
2,568,728 9/1951 Goldsby et al. .
2,649,985 8/1953 Moyer .
2,740,549 4/1956 Graham et al. .
2,790,574 4/1957 Consani .
2,790,575 4/1957 Wiggins .
2,801,763 8/1957 Ulm .
2,803,371 8/1957 Edens .
2,888,161 5/1959 Springer .
2,936,925 5/1960 Moyer et al. .
2,960,252 11/1960 Ulm .
3,019,935 2/1962 Anderson, Sr. .
3,033,413 5/1962 Fino et al. .
3,043,468 7/1962 Horner, Jr. .
3,048,298 8/1962 Lessing et al. .
3,119,511 1/1964 Giannini .
3,158,280 11/1964 Wiggins .
3,185,335 5/1965 Lecler .
3,307,733 3/1967 De Bock .
3,319,329 5/1967 Knutsen et al. .
3,390,803 7/1968 Smith .
3,595,432 7/1971 Van der Heijden et al. .
3,618,813 11/1971 Nishkian et al. .
3,625,415 12/1971 Nelson et al. .
3,678,792 7/1972 Dvorak .
3,735,891 5/1973 Nishkian et al. .
3,795,339 3/1974 Barbier .
4,004,708 1/1977 Boyd .
4,036,395 7/1977 Tuckey .
4,099,643 7/1978 Wardwell et al. .
4,116,358 9/1978 Kinghorn et al. ..... 220/222
4,130,216 12/1978 Creith .
4,130,217 12/1978 Hills et al. .
4,154,359 5/1979 Bissett .
4,174,785 11/1979 Garnett .
4,191,303 3/1980 Kinghorn, Sr. et al. .
4,258,858 3/1981 Russell .
4,273,250 6/1981 Kinghorn, Sr. et al. .
4,287,999 9/1981 Heisterberg .
4,308,968 1/1982 Thiltgen et al. .
4,353,477 10/1982 Bruening .
4,353,478 10/1982 Clark .
4,371,090 2/1983 Ogarek et al. .
4,397,399 8/1983 Wagoner .
4,437,577 3/1984 Myers et al. .
4,524,878 6/1985 Imhof .
4,540,104 9/1985 Kawai et al. .
4,615,458 10/1986 Grove et al. .
4,811,859 3/1989 Kinghorn, Jr. .
5,036,995 8/1991 Wagoner .
5,103,992 4/1992 Lippiello et al. .
5,284,269 2/1994 Petrie et al. ..... 220/224
5,301,828 4/1994 McKay .
5,321,881 6/1994 Lippiello et al. .
5,351,848 10/1994 Wagoner .

MOUNTING SYSTEM FOR FLOATING ROOF SEALS

FIELD OF THE INVENTION

The present invention relates generally to a sealing system for rim space between a floating roof on a liquid storage tank, and more particularly to a mounting system for a primary and secondary rim seal on a floating roof which permits the removal or replacement of the secondary seal without affecting the primary seal integrity.

BACKGROUND ART

Petroleum products and hydrocarbon liquids are commonly stored in large cylindrical tanks sealed by roofs which float upon the liquid contained within the tanks to prevent contamination of the liquid and the escape of vapors into the atmosphere. Various sealing arrangements are known in the art and are shown, for example, in U.S. Pat. Nos. 4,811,859, 4,353,477, and 5,036,995.

Many of these sealing systems, such as the one disclosed in U.S. Pat. No 4,811,859, comprise a primary or continuous seal and a secondary seal which are mounted on a rim extending upwardly from the floating roof. Both the primary seal and the secondary seal contact an inner wall surface of the cylindrical storage tank and prevent external contaminants from entering the tank and vapors from escaping the tank. The primary and secondary seals are generally mounted on a rim extending upwardly from the top of the floating roof. It is difficult to remove or replace the secondary seal from the rim without compromising the effectiveness of the primary seal, which may result in harmful vapors escaping from the tank. Therefore, there remains a need for a simple system for mounting the primary seal and the secondary seal to the floating roof which permits the removal or replacement of the secondary seal without affecting the primary seal connection and which does not require additional parts or expense in manufacturing or installation.

SUMMARY OF THE INVENTION

In accordance with the present invention, an apparatus for sealing the space between a floating roof and a tank wall in a liquid storage tank includes a primary seal having a first end in sealing arrangement with the tank wall and a second end connectable to a rim extending upwardly from the floating roof; a secondary seal having a first end in sealing contact with the tank wall and a second end connectable to the rim; a bolt insertable through apertures in the rim, the primary seal and the secondary seal for connecting the seals to the rim; and means for releasing the secondary seal from the rim while maintaining the primary seal connection, including a retainer connectable to the bolt for securing the primary seal to the rim and a nut connectable to the bolt for securing the secondary seal to the rim.

Also in accordance with the present invention, the rim may extend vertically or horizontally from a top deck of the floating roof. Further, a gasket, such as compressible foam tape, may be attached adjacent the rim. Also, a first washer bar may be interposed between the head of the bolt and the primary seal to maintain sealing contact between the primary seal and the rim and a second washer bar may be interposed between the nut and the secondary seal to maintain sealing contact between the secondary seal and the rim.

According to another aspect of the present invention, a method for mounting a primary seal and a secondary seal on a floating roof for sealing the space between the floating roof and a tank wall in a liquid storage tank comprises aligning an aperture in the primary seal with an aperture in a rim extending upwardly from the roof; inserting a bolt through the primary seal and the rim apertures; connecting a retainer to the bolt to secure the primary seal to the rim; aligning an aperture in the secondary seal with the bolt; and connecting a nut to the bolt to releasably secure the secondary seal to the rim while maintaining the primary seal connection when the secondary seal is released.

DETAILED DESCRIPTION OF THE DRAWINGS

Figure 1:
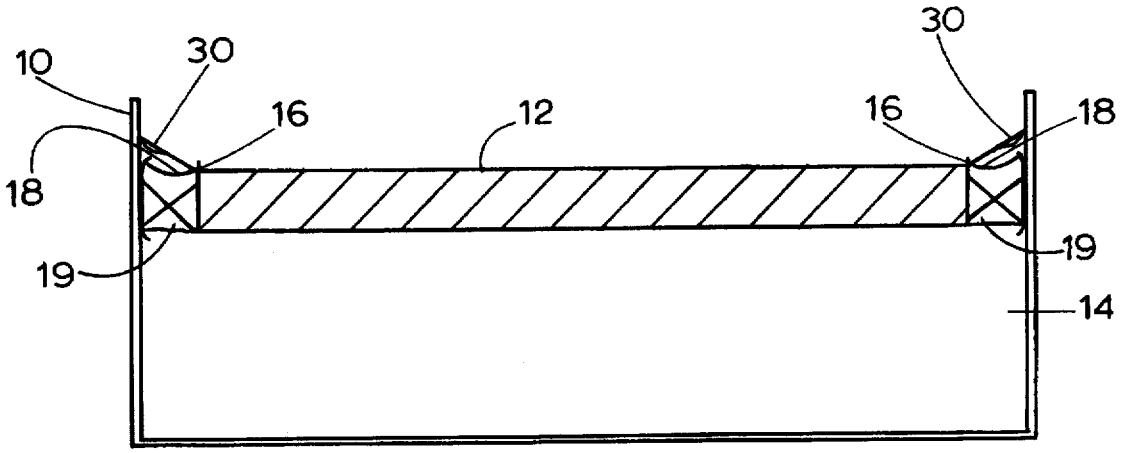
FIG. 1 is a cross-sectional view of a liquid storage tank having a floating roof rim space sealed with primary and secondary seals.
Figure 2:
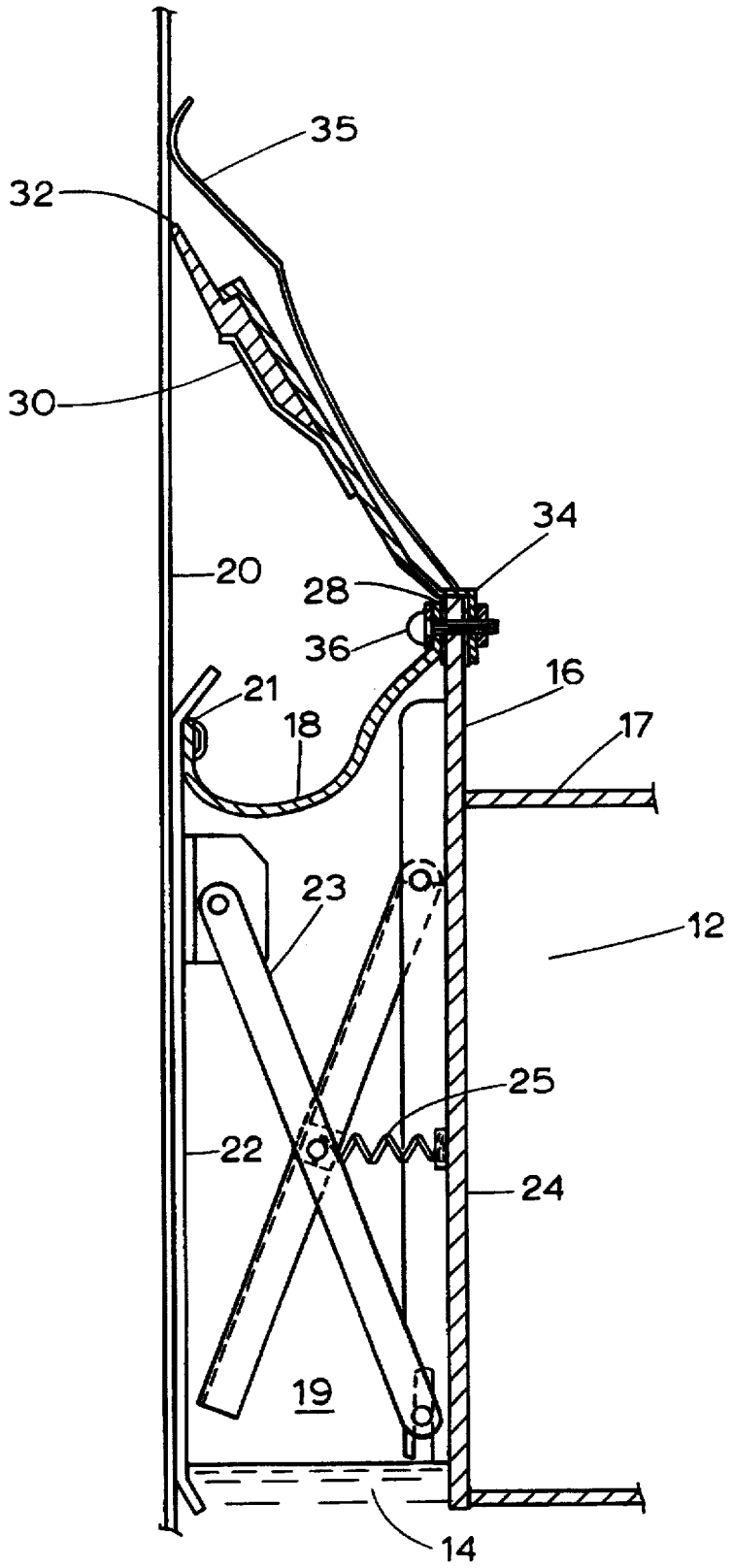
FIG. 2 is a cross-sectional view of the vertical mounting sealing system of the present invention.

Referring to FIGS. 1 and 2, a cylindrical liquid storage tank 10 is covered by a roof 12 which floats upon a liquid 14 contained within the tank 10. An outer rim 16 extends vertically upward from a top deck 17 of the floating roof 12. A primary continuous seal 18 seals a space 19 between the floating roof 12 and a primary mechanical shoe 22 which is in close contact with the inner tank wall 20 and prevents harmful vapors produced by the liquid 14 from entering the atmosphere. Further, the primary seal 18 prevents rain, snow, dirt and the like from entering the tank 10 and contaminating the liquid 14 contained therein.

In one embodiment, a first end 21 of the primary seal 18 is connected to the mechanical shoe 22 which contacts the inner tank wall 20. A plurality of shoe segments are connected around the circumference of the floating roof 12. The shoe 22 is supported by a pantagraph hanger assembly 23 which is secured to a side wall 24 of the floating roof 12 with any suitable connector such as a bolt or weld and which urges the shoe 22 towards the tank wall 20 with a coil spring 25, for example. The shoe 22 extends below the level of the liquid 14 in the tank 10 so that the majority of vapors emitted by the liquid 14 are trapped in the space 19 below the primary seal 18, which is made of a flexible material that is impervious to vapors. A second end 28 of the primary seal 18 is connected to the rim 16 extending from the floating roof 12.

A secondary seal 30 further seals the space 19 between the tank wall 20 and the roof 12 to prevent escape of vapors and contamination of the liquid 14. A first end 32 of the secondary seal 30 is in wiping contact with the inner surface of the tank wall 20 and a second end 34 of the secondary seal 30 is connected to the rim 16 extending upwardly from the floating roof 12. A shunt 35 in resilient contact with the tank wall 20 may optionally be installed above the secondary seal 30 to provide an electrical path for static or lightning induced electricity from the floating roof 12 to the tank wall 20 so that any arcing resulting from the flow of electricity occurs near the shunt 35 and away from the potentially volatile vapors stored below the seals 18 and 30.

To avoid the use of complicated and duplicative attachments for both the primary seal 18 and the secondary seal 30, the present invention provides a simple, quick, and inexpensive system for mounting the seals 18 and 30 to the rim 16 by using the same bolts 36 to connect both seals to the rim 16, as opposed to separate bolts and rim apertures for each. Further, the mounting system of the present invention eliminates the need for a horizontal rim angle attachment to the roof 12 by allowing for a vertical rim which requires less labor and material.

Figure 3:
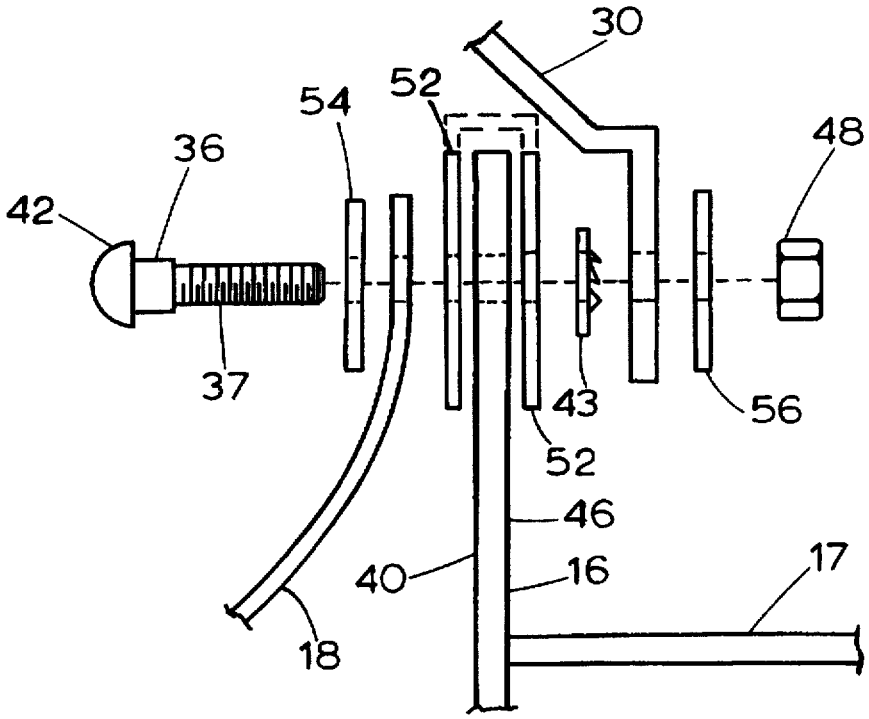
FIG. 3 is an enlarged, exploded view of the vertical mounting system of FIG. 2.

FIG. 3 is an enlarged view of the seal mounting detail of FIG. 2. The flexible primary seal 18 defining an aperture 38 is connected adjacent a first side 40 of the rim 16 and is draped outwardly toward a mechanical shoe segment (not illustrated). The secondary seal 30, defining an aperture 39, is a resilient bent plate extending upward and then outward toward the tank wall. The primary seal aperture 38 is aligned with secondary seal aperture 39 and with an aperture 41 in the rim 16 so that all apertures may receive a single bolt 36. The bolt 36 includes a head 42 and a threaded portion 37, and is oriented so that the bolt head 42 is adjacent the primary seal 18 on the outside of the rim 16 and directed inward such that the threads 37 will extend through the apertures and be accessible from the top deck 17 of the floating roof 12.

The primary seal 18 is secured to the rim 16 by threading a retainer 43 to the threaded portion 37 of the bolt 36 on the second side 46 of the rim 16. The secondary seal 30 is then secured to the rim 16 with a nut 48.

Figure 4:
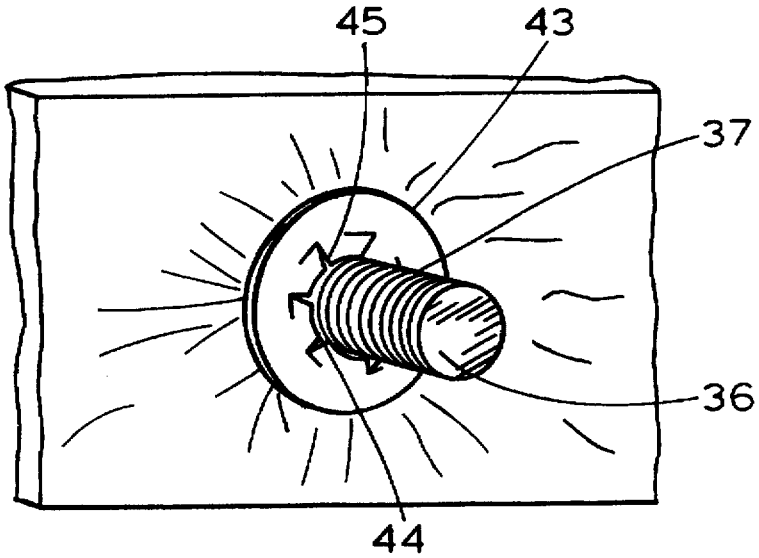
FIG. 4 is a perspective view of a push nut retainer connected to the bolt utilized in the mounting system of the present invention.

FIG. 4 illustrates the connection of the retainer 43 to the bolt 36. The retainer 43 optimally is a washer-type push nut, such as a Tinnerman Pushnut®, which is fabricated from thin steel and includes a central bore 44 of suitable diameter to receive the bolt 36. The bore 44 is surrounded by a plurality of teeth 45 which interlock with the threads 37 on the bolt 36 when the retainer 43 is connected. Thus, the retainer 43 locks onto the bolt 36, firmly securing the primary seal 18 to the rim 16.

Referring back to FIG. 3, gaskets 52 comprising compressible adhesive-backed foam tape (such as Volara® tape manufactured by Foamade Industries of Auburn Hills, Mich.) are applied to the sides 40 and 46 of the rim 16. Alternatively, a gasket 52 may extend along the sides and across the top of the rim 16 in an inverted U-shape (illustrated by the dashed line in FIG. 3. The foam gasket tape 52 is locally compressed by and envelops the retainer 43 when the retainer 43 is tightened securely on the bolt 36, providing a tight seal and preventing any escape of vapors through the apertures and along the edge of the rim.

A washer bar 54 made of arcuate segments extending horizontally around the circumference of the rim 16 may be interposed between the bolt head 42 and the primary seal 18 to maintain sealing contact between the rim 16 and the seal 18. Similarly, a second washer bar 56 may be interposed between the nut 48 and the secondary seal 30 to maintain sealing contact between the rim 16 and the secondary seal 30.

Figure 5A:
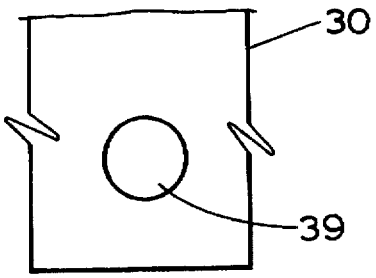
FIGS. 5A and 5B are alternative embodiments of the secondary seal apertures included in the mounting system of the present invention.
Figure 5B:
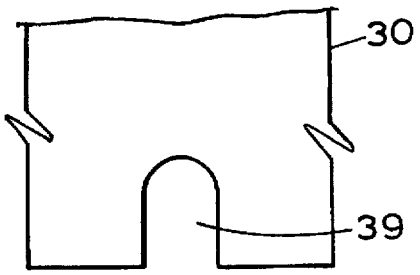

In accordance with this mounting system, the secondary seal 30 may be easily installed, removed or repaired without affecting the sealing arrangement between the primary seal 18 and the tank wall 20. The apertures 39 in the secondary seal 30 may comprise holes (as shown in FIG. 5A), slots (as shown in FIG. 5B), or any other configuration sufficient to receive the bolt 36. The secondary seal 30 may be disconnected from the rim 16 by removing the nut 48 and pulling the FIG. 5A embodiment of the second end 34 of the secondary seal 30 off the bolt 36 or by loosening the nut 48 and sliding the FIG. 5B embodiment of the second end 34 of the secondary seal 30 up and off the bolt 36. With either configuration, the primary seal 18 will stay secured to the rim 16 by the retainer 43 and maintain contact with the mechanical shoe 22. Maintaining the primary seal connection in this manner prevents escape of dangerous vapors into the atmosphere or contamination of the liquid 14 in the tank 10 during installation or repair of the secondary seal 30 without the need for a separate bolting arrangement that adds parts and labor to the original installation of the seals.

Further, the mounting system of the present invention requires only the vertical rim 16 extending from the floating roof 12. This vertical mount is advantageous because it eliminates the expense of labor and additional materials necessary for a horizontal rim angle.

Figure 6:
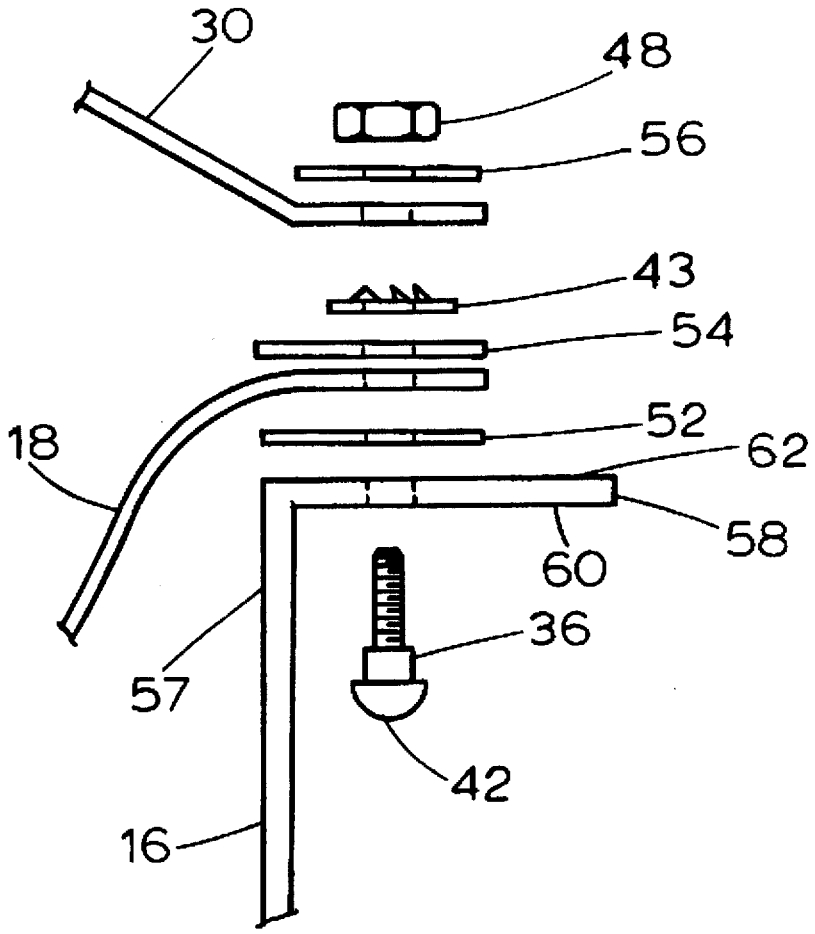
FIG. 6 is an enlarged, exploded view of an alternative horizontal mounting system of the present invention.

However, as shown in FIG. 6, the mounting system of the present invention may alternatively be adapted for use with a horizontal rim when present. In the horizontal mounting configuration, the rim 16 extends upwardly from the top deck 17 of the floating roof 12 and is welded or otherwise secured to a rim angle 57 having a horizontal flange 58. The bolt head 42 is adjacent a bottom side 60 of the horizontal flange 58 and the bolt 36 extends upwardly through a top side 62 of the horizontal flange 58 to provide easy access to the nut 48 and the retainer 43.

The primary seal 18 is connected to the bolt 36 adjacent the top side 62 of the horizontal flange 58 and is secured by the retainer 43. The secondary seal 30 is connected to the bolt 36 atop of the retainer 43 and secured with the nut 48. Thus, the secondary seal 30 may be installed or removed while the primary seal 18 remains secured to the rim 16 by the retainer 43.

The horizontal mounting of FIG. 6 also includes the gasket 52 between the primary seal 18 and the horizontal flange 58. Washer bar 54 may be interposed between the retainer 43 and the primary seal 18 to enhance the sealing connection of the seal 18 to the rim 16. Likewise, washer bar 56 may be interposed between the nut 48 and the secondary seal 30. Further, the mounting configuration shown in FIG. 6 with the bolt head 42 located on the bottom side 60 of the horizontal flange 58 allows for easy access to the nut 48 and the retainer 43. However, the configuration may be reversed such that the bolt head 42 is adjacent the top side 62 of the horizontal flange 58.

Modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which are within the scope of the appended claims is reserved.

It is claimed:

1. An apparatus for sealing the space between a floating roof and a tank wall in a liquid storage tank, in which the floating roof includes a rim extending upwardly from the floating roof and the rim has an aperture therethrough; the apparatus comprising:

a primary seal having a first end in sealing arrangement with the tank wall, and a second end connectable to the rim, wherein the second end has an aperture therethrough aligned with the rim aperture;

a secondary seal having a first end in sealing contact with the tank wall, and a second end connectable to the rim, wherein the second end has an aperture therethrough aligned with the rim and primary seal apertures;

a bolt insertable through the apertures in the rim, the primary seal and the secondary seal;

a first gasket interposed between the rim and the primary seal, wherein the gasket comprises compressible foam tape; and means for releasing the secondary seal from the rim while maintaining the primary seal connection to the rim, including, a retainer connectable to the bolt for joining the primary seal to the rim, and a nut connectable to the bolt for joining the secondary seal to the rim.

2. The apparatus of claim 1, wherein the second end of the secondary seal is interposed between the retainer and the nut.

3. The apparatus of claim 1, wherein the retainer, the nut and the secondary seal are connected to the bolt on a first side of the rim and the primary seal is connected to the bolt on a second side of the rim.

4. The apparatus of claim 1, wherein the rim extends vertically from the top deck of the floating roof.

5. The apparatus of claim 1, wherein the rim comprises an angle having a vertical portion and a horizontal portion defining the aperture.

6. The apparatus of claim 1, and further comprising a washer bar having an aperture for receiving the bolt and means for maintaining sealing contact between the primary seal and the rim.

7. The apparatus of claim 1, and further comprising a washer bar having an aperture for receiving the bolt and means for maintaining sealing contact between the primary seal and the rim, wherein the washer bar is interposed between a head of the bolt and the primary seal.

8. The apparatus of claim 1, and further comprising:

a first washer bar having an aperture for receiving the bolt and having means for maintaining sealing contact between the primary seal and the rim; and a second washer bar having an aperture for receiving the bolt and having means for maintaining sealing contact between the secondary seal and the rim.

9. The apparatus of claim 1, wherein the retainer comprises a push nut.

10. The apparatus of claim 1, wherein the rim comprises a rim angle having a horizontal flange.

11. An apparatus for sealing the space between a floating roof and a tank wall in a liquid storage tank, in which the floating roof includes a rim extending upwardly from the floating roof and the rim has an aperture therethrough; the apparatus comprising:

a primary seal having a first end in sealing arrangement with the tank wall, and a second end connectable to the rim, wherein the second end has an aperture therethrough aligned with the rim aperture;

a secondary seal having a first end in sealing contact with the tank wall, and a second end connectable to the rim, wherein the second end has an aperture therethrough aligned with the rim and primary seal apertures:

a bolt insertable through the apertures in the rim, the primary seal and the secondary seal;

means for releasing the secondary seal from the rim while maintaining the primary seal connection to the rim, including, a retainer connectable to the bolt for joining the primary seal to the rim, and a nut connectable to the bolt for joining the secondary seal to the rim;

a first washer bar having an aperture for receiving the bolt and having means for maintaining sealing contact between the primary seal and the rim; and a second washer bar having an aperture for receiving the bolt and having means for maintaining sealing contact between the secondary seal and the rim, wherein the first washer bar is interposed between a head of the bolt and the primary seal and the second washer bar is interposed between the nut and the secondary seal.

12. The apparatus of claim 11, wherein the second end of the secondary seal is interposed between the retainer and the nut.

13. The apparatus of claim 11, wherein the retainer, the nut and the secondary seal are connected to the bolt on a first side of the rim and the primary seal is connected to the bolt on a second side of the rim.

14. The apparatus of claim 11, wherein the rim extends vertically from the top deck of the floating roof.

15. The apparatus of claim 11, wherein the rim comprises an angle having a vertical portion and a horizontal portion defining the aperture.

16. The apparatus of claim 11, and further comprising a first gasket interposed between the rim and the primary seal.

17. The apparatus of claim 11, and further comprising a first gasket interposed between the rim and the primary seal, wherein the gasket comprises compressible foam tape.

18. The apparatus of claim 11, wherein the retainer comprises a push nut.

19. The apparatus of claim 11, wherein the rim comprises a rim angle having a horizontal flange.

20. An apparatus for sealing the space between a floating roof and a tank wall in a liquid storage tank, in which the floating roof includes a rim extending upwardly from the floating roof and the rim has an aperture therethrough; the apparatus comprising:

a primary seal having a first end in sealing arrangement with the tank wall, and a second end connectable to the rim, wherein the second end has an aperture therethrough aligned with the rim aperture;

a secondary seal having a first end in sealing contact with the tank wall, and a second end connectable to the rim, wherein the second end has an aperture therethrough aligned with the rim and primary seal apertures;

a bolt insertable through the apertures in the rim, the primary seal and the secondary seal;

means for releasing the secondary seal from the rim while maintaining the primary seal connection to the rim, including, a retainer connectable to the bolt for joining the primary seal to the rim, and a nut connectable to the bolt for joining the secondary seal to the rim; and a first gasket interposed between the rim and the primary seal and a second gasket interposed between the rim and the retainer.

21. The apparatus of claim 20, wherein the first and second gaskets comprise compressible foam tape.

22. The apparatus of claim 20, wherein the second end of the secondary seal is interposed between the retainer and the nut.

23. The apparatus of claim 20, wherein the retainer, the nut and the secondary seal are connected to the bolt on a first side of the rim and the primary seal is connected to the bolt on a second side of the rim.

24. The apparatus of claim 20, wherein the rim extends vertically from the top deck of the floating roof.

25. The apparatus of claim 20, wherein the rim comprises an angle having a vertical portion and a horizontal portion defining the aperture.

26. The apparatus of claim 20, and further comprising a washer bar having an aperture for receiving the bolt and means for maintaining sealing contact between the primary seal and the rim.

27. The apparatus of claim 20, and further comprising a washer bar having an aperture for receiving the bolt and means for maintaining sealing contact between the primary seal and the rim, wherein the washer bar is interposed between a head of the bolt and the primary seal.

28. The apparatus of claim 20, and further comprising:

a first washer bar having an aperture for receiving the bolt and having means for maintaining sealing contact between the primary seal and the rim; and a second washer bar having an aperture for receiving the bolt and having means for maintaining sealing contact between the secondary seal and the rim.

29. The apparatus of claim 20, wherein the retainer comprises a push nut.

30. The apparatus of claim 20, wherein the rim comprises a rim angle having a horizontal flange.

31. An apparatus for sealing the space between a floating roof and a tank wall in a liquid storage tank, in which the floating roof includes a rim extending upwardly from the floating roof and the rim has an aperture therethrough; the apparatus comprising:

a primary seal having a first end in sealing arrangement with the tank wall, and a second end connectable to the rim, wherein the second end has an aperture therethrough aligned with the rim aperture;

a secondary seal having a first end in sealing contact with the tank wall, and a second end connectable to the rim, wherein the second end has an aperture therethrough aligned with the rim and primary seal apertures;

a bolt insertable through the apertures in the rim, the primary seal and the secondary seal;

means for releasing the secondary seal from the rim while maintaining the primary seal connection to the rim, including, a retainer connectable to the bolt for joining the primary seal to the rim, and a nut connectable to the bolt for joining the secondary seal to the rim; and a gasket wrapped around the rim and interposed between the rim and the primary seal and between the rim and the retainer.

32. The apparatus of claim 31, wherein the gasket comprises compressible foam tape.

33. The apparatus of claim 31, wherein the second end of the secondary seal is interposed between the retainer and the nut.

34. The apparatus of claim 31, wherein the retainer, the nut and the secondary seal are connected to the bolt on a first side of the rim and the primary seal is connected to the bolt on a second side of the rim.

35. The apparatus of claim 31, wherein the rim extends vertically from the top deck of the floating roof.

36. The apparatus of claim 31, wherein the rim comprises an angle having a vertical portion and a horizontal portion defining the aperture.

37. The apparatus of claim 31, wherein the retainer comprises a push nut.

38. The apparatus of claim 31, wherein the rim comprises a rim angle having a horizontal flange.

39. A method for mounting a primary seal and removably mounting a secondary seal on a floating roof for sealing the space between the floating roof and a tank wall in a liquid storage tank, wherein the floating roof includes a rim extending upwardly therefrom and an aperture therethrough; the method comprising the steps of:

a) aligning an aperture in the primary seal with the rim aperture;

b) inserting a bolt through the apertures in the primary seal and the rim;

c) connecting a retainer to the bolt to join the primary seal to the rim;

d) aligning an aperture in the secondary seal with the bolt;

e) inserting the bolt through the secondary seal apertures;

f) connecting a nut to the bolt to removably join the secondary seal to the rim; and g) sealing the interface between the primary seal and the rim with a compressible gasket material.

40. The method of claim 39, and further comprising the step of releasing the secondary seal from the rim by loosening the nut from the bolt.

41. The method of claim 39, and further comprising the step of inserting the bolt through an aperture in a washer bar before inserting the bolt through the apertures in the primary seal and the rim.

42. The method of claim 39, and further comprising the step of inserting the bolt through an aperture in a washer bar before connecting the nut to the bolt.

43. A method for mounting a primary seal and removably mounting a secondary seal on a floating roof for sealing the space between the floating roof and a tank wall in a liquid storage tank, wherein the floating roof includes a rim extending upwardly therefrom and an aperture therethrough; the method comprising the steps of:

a) aligning an aperture in the primary seal with the rim aperture;

b) inserting a bolt through the apertures in the primary seal and the rim;

c) connecting a retainer to the bolt to join the primary seal to the rim;

d) aligning an aperture in the secondary seal with the bolt;

e) inserting the bolt through the secondary seal apertures;

f) connecting a nut to the bolt to removably join the secondary seal to the rim; and g) sealing the interface between the retainer and the rim with a compressible gasket material.

44. The method of claim 43, and further comprising the step of releasing the secondary seal from the rim by loosening the nut from the bolt.

45. The method of claim 43, and further comprising the step of inserting the bolt through an aperture in a washer bar before inserting the bolt through the apertures in the primary seal and the rim.

46. The method of claim 43, and further comprising the step of inserting the bolt through an aperture in a washer bar before connecting the nut to the bolt.

* * * * *